United States Patent [19]

Takahashi et al.

[11] Patent Number: 4,671,021

[45] Date of Patent: Jun. 9, 1987

[54] GRINDING TOOL

[75] Inventors: Kunio Takahashi, Nagoya; Yasuhisa Sekiya, Toyokawa, both of Japan

[73] Assignee: Toyoda Van Moppes Limited, Okazaki, Japan

[21] Appl. No.: 789,770

[22] Filed: Oct. 21, 1985

[30] Foreign Application Priority Data

Oct. 22, 1984 [JP] Japan ..... 59-221410

[51] Int. Cl.[4] ..... B24D 3/02

[52] U.S. Cl. ..... 51/204; 51/307; 51/293

[58] Field of Search ..... 51/307, 309, 300, 293, 51/295, 308, 206 R, 204

[56] References Cited

U.S. PATENT DOCUMENTS 2,258,774 10/1941 Kuzmick .
3,402,035 9/1968 Martin ..... 51/309

FOREIGN PATENT DOCUMENTS 47-38515 7/1972 Japan .
51-39398 10/1976 Japan .
51-38192 10/1976 Japan .
53-8950 4/1978 Japan .
56-52181 12/1981 Japan .

*Primary Examiner*—Frederick R. Schmidt
*Assistant Examiner*—Maurina Rachuba
*Attorney, Agent, or Firm*—Cushman, Darby & Cushman

[57] ABSTRACT

A grinding tool has diamond superabrasive grains as the abrasive and a bond to retain the abrasive grains. The bond is made of organic polymer or metal and contains as a filler both a solid film-forming lubricant and finely divided diamond superabrasive grains having a grain size smaller than one-third that of the diamond superabrasive grains as the abrasive. The grinding tool of this invention is suitable for grinding a hard cutting material such as cutting tools made of titanium nitride cermet and exhibits outstanding cutting performance and durability.

7 Claims, No Drawings

GRINDING TOOL

BACKGROUND OF THE INVENTION

1. Field of the Invention

The present invention relates to a grinding tool of the type in which the abrasive is diamond known as the hardest abrasive.

2. Description of the Prior Art

The recent development of new materials is remarkable. Most noteworthy among them is a cermet of titanium nitride which is a new species of ceramics. It is a new material having characteristics combining the properties of ceramics and metals, such as high hardness and heat resistance characteristic of ceramics and toughness characteristic of metals. It is finding more uses as a material for high-performance cutting tools such as throwaway chips and reamers, in place of the conventional cemented carbides and old ceramics.

Heretofore, a grinding tool made of diamond superabrasive grains has been in use for truing and sharpening the cutting tools made of cermet. However, it has the disadvantage of being poor in grinding efficiency and life because of the difficulties encountered in grinding the hard cutting material.

In the case of titanium nitride cermet having high hardness and low thermal conductivity, the pressure and temperature at the grinding point are much higher than those which are experienced in the grinding of the conventional cemented carbide. This easily wears the superabrasive grains forming the cutting edge of the grinding tool, and in an extreme case, induces the crushing and releasing of the superabrasive grains. A grinding tool usually undergoes, before use, dressing to improve and keep its sharpness(free-cut performance). Dressing makes the cutting edge of the superabrasive grains project several tens of micron from the surface of the bond. When the amount of projection decreases to ten micron or less due to wear of the cutting edge, the grinding resistance rapidly increases due to friction between the work or chips thereof and the bond, and the temperature at the grinding point and its adjacent parts rises still more due to friction heat. This in turn causes fatal burn mark, crack, and chipping to the work, and also accelerates the attrition wear and breaking down of superabrasive grains, shortening the life of the expensive grinding tool to a great extent. In addition, at high temperatures, titanium nitride cermet has a tendency that the metal component thereof readily sticks to the surface of the grinding tool. This results in the surface of the grinding tool being loaded with the metal component and the grinding tool becoming dull very soon.

The above mentioned phenomena greatly reduces the sharpness and Life of the grinding tool and deteriorates the finishing performance of the grinding tool in a short time.

The following are the major countermeasures conventionally taken so far to cope with the problems mentioned above.

(1) Using superabrasive grains of comparatively small grain size (from 230 to 270 mesh, 64 μm on the average).

Superabrasive grains of large grain size form a large flat area at the grain tips when they have worn out, which in turn increases grinding resistance, generates grinding heat, and causes edge chipping. Superabrasive grains of excessively small grain size, however, are easily released from the bond because they are not firmly retained thereto.

(2) Using an organic polymeric substance as the bond which is superior in self-lubrication to a metal-based bond and has a proper degree of resilience.

The metal-based bond generates a large amount of friction heat when it comes into direct contact with the work after the abrasive grains have worn out. In addition, it makes such a stiff contact with the work that it causes chipping to the cutting edge of the tool being ground.

(3) Incorporating the bond with a solid film-forming lubricant such as graphite, boron nitride of hexagonal system, tungsten disulfide, and molybdenum disulfide.

This is effective in reducing friction heat that generates between the bond and the work.

(4) Incorporating the bond with a fine powder of silver or copper.

This is effective in increasing the thermal conductivity of the bond and the dissipation of friction heat.

(5) Using as the bond a porous metal matrix impregnated with a liquid resin.

This type of bond has both the thermal conductivity characteristic of the metal bond and the resilience characteristic of the organic polymer bond.

(6) In corporating the bond of organic polymeric substance with 10 to 30% (by volume) of lead powder.

This is effective in preventing the grinding tool from loading with sticking chips and in improving the thermal conductivity of the bond.

The above mentioned countermeasures, however, have not proved themselves to be highly effective. It is still a great difficulty to efficiently and neatly grind hard cutting materials such as titanium nitride cermet. The efficiency of grinding the cutting tools of titanium nitride cermet is only one-several or one-several tenths of that of grinding the cutting tools of conventional cemented carbide.

SUMMARY OF THE INVENTION

It is an object of the present invention to provide a grinding tool which is suitable for grinding hard cutting materials such as cutting tools made of cermet.

It is another object of the present invention to provide a grinding tool which has a high grinding efficiency, a long life, and an ability to make neat finishing.

DETAILED DESCRIPTION OF THE INVENTION

The feature of this invention is that the grinding tool is made up of diamond grains as the abrasive and an organic polymer such as phenolic resin or a metal such as Cu-Sn alloy, as the base material of the bond, and that the bond contains a solid film-forming lubricant and a filler of fine diamond grains having an average grain size smaller than one-third that of the diamond grains used as the abrasive.

The diamond grains used as the abrasive in this invention have a grain size of about 170 to 400 mesh, preferably 200 to 270 mesh, and the content of the abrasive in the bond is about 15 to 50 vol %, preferably 20 to 32 vol %.

The diamond grains used as the filler of the bond should have a grain size smaller than one-third that of the diamond grains used as the abrasive, and preferably the grain size should be smaller than 20 μm(800 mesh). The content of the filler in the bond should be 3 to 30 vol %, preferably 4 to 10 vol %. The fine diamond grains incorporated into the bond improve the wear resistance of the bond. In addition, they positively grind and discharge the surface layer and chips of the work which would otherwise come into contact with the bond, whereby preventing loading. This is also effective in preventing the accumulation of friction heat and reducing the breaking down of abrasive grains. Moreover, the filler produces a synergistic effect with the solid-film forming lubricant in greatly improving the ability to grind titanium nitride cermets.

If the grain size of the filler is larger than speciifed above, leading is more likely to occur. If the amount of the filler is excessively large, the amount of the bond decreases accordingly and the retention of the abrasive grains decreases, which shortens the life of the grinding tool.

The solid film-forming lubricant is a known substance that forms and deposits a lubricating solid film on the friction surface of the bond. The one that can be used in this invention includes inorganic materials such as boron nitride of hexagonal system and tungsten disulfide. In the case of organic polymer bond, the amount of the solid film-forming lubricant in the bond is 3 to 20 vol %, preferably 5 to 10 vol %, and in the case of metal bond, it is 5 to 40 vol %, preferably 10 to 30 vol %.

If the total amount of the filler and lubricant is less than the above-mentioned lower limit, their effect is little, and in the opposite case, the amount of the base material of the bond is not enough to firmly retain the abrasive grains and the abrasive grains are easily released. The metal bond permits the incorporation of more lubricant than the organic polymer bond because the former has a greater capacity to retain abrasive grains than the latter.

It is preferable to coat at least one of the diamond grains as the abrasive and those as the filler with Cu or Ni for improving the retaining force and thermal conductivity of the diamond grains.

EXAMPLES

Ten straight grinding wheels of the same shape(14A1 type, 150mm in diameter, 8 mm in width of abrasive layer) were prepared, each containing a varied kind and amount of filler in the bond. These wheels were used for wet surface grinding of the periphery of a titanium nitride(TiN) cermet chip (19.1 mm long, 19.1 mm wide, and 4.7 mm thick) under the same conditions (depth of cut : 0.03 mm, table traversing: 6 m/min, peripheral speed of wheel : 28.3 m/sec, coolant : chemical solution type).

After grinding, the grinding wheels were examined for life and sharpness and the ground surface were examined for finishing quality. The results are shown in Tables 1 and 2, in which wheel Nos. 1 to 3 represent the grinding wheels of this invention and wheel Nos. 4 to 10 represent the comparative products.

The life of the grinding wheel was evaluated in terms of grinding ratio $G_R$ which is the ratio of the volume of the ground TiN cermet to the volume of the worn grinding wheel. The sharpness of the grinding wheel was evaluated in terms of the input electric current required to perform grinding. The finishing quality was evaluated according to the presence or absence of chipping at the corners of the chip.

The grinding wheels No. 4 and No. 8 in Table 1 are the typical diamond wheels containing 30 vol % of silicon carbide (SiC). The $\%G_R$ and %A in Table 2 is a relative value compared with that of wheel No. 4 as the reference.

It is noted from Table 2 that where the typical wheels (No. 4 and No. 8) containing only silicon carbide (grain size 800 mesh) as a filler in the bond of diamond wheels are used for the grinding of titanium nitride cermet, the life of the wheels is not improved even through the amount of abrasive is increased above 20 carats, rather the grinding performance is detoriorated by loading.

Where tungsten disulfide (WS2), a solid film-forming lubricant, is used alone as a filler (as in No. 5 and No. 6), or where finely divided diamond is used alone as a filler (as in No. 7), the life of the wheel is 50 to 60% longer and the sharpness is 30 to 40% better than the reference wheel (No. 4). Improvement more than 100% was almost impossible even if the grain size and amount of the filler were changed. The wheel No. 10 containing no fillers in the metal bond caused large chipping to the cermet chip.

On the other hand, the wheels (No. 1, No. 2 and No. 3) of this invention which contain both tungsten disulfide and finely divided diamond as a filler are greatly improved in life ($G_R$) and sharpness and provide the best finishing surface among the wheels examined. This experimental result shows that the synergistic effect of the above two fillers is obtained. Especially in the case of No. 1, the life was extended more than six times and the sharpness was improved nearly 60%. Incidentally, the amount of diamond used as a filler in the wheels of this invention was 3.8 carats, and the total amount of diamond as filler and abrasive was 23.8 carats. This amount is a little smaller than that of the conventional standard wheel No. 7 (diamond concentration =100).

The grinding wheels of this invention can be produced with the existing equipment and technology for the conventional standard resin bond diamond wheels or metal bond diamond wheels.

In the present invention, polyimide resin can be used as the organic polymer for the bond in place of phenolic resin.

TABLE 1

| Wheel | Abrasive | | | Content of filler in bond (vol %) | | | |
|---|---|---|---|---|---|---|---|
| No. | Kind | Amount | bond | SiC | Cu | $WS_2$ | Finely divided diamond |
| 1 | Diamond | 20 ct | Phenolic resin | 0 | 0 | 5.5 | 5 (ave. grain size 2 μm) |
| 2 | Diamond | 20 ct | Phenolic resin | 0 | 0 | 5.5 | 5 (ave. grain size 20 μm) |
| 3 | Diamond | 20 ct | Cu—Sn alloy | 0 | 0 | 20 | 5 (ave. grain size 2 μm) |
| 4 | Diamond | 20 ct | Phenolic resin | 30 | 0 | 0 | 0 |
| 5 | Diamond | 20 ct | Phenolic resin | 0 | 0 | 5.5 | 0 |
| 6 | Diamond | 20 ct | Phenolic resin | 0 | 0 | 10 | 0 |
| 7 | Diamond | 20 ct | Phenolic resin | 0 | 0 | 0 | 5 (ave. grain size 2 μm) |
| 8 | Diamond | 25 ct | Phenolic resin | 30 | 0 | 0 | 0 |
| 9 | Diamond | 25 ct | Polyimide resin | 0 | 40 | 0 | 0 |
| 10 | Diamond | 20 ct | Cu—Sn alloy | 0 | 0 | 0 | 0 |

TABLE 2

| Wheel No. | Life of grinding wheel: Grinding ratio. $G_R$ | Life of grinding wheel: % $G_R$ | Sharpness of grinding wheel: Current required for grining (A) | Sharpness of grinding wheel: % A | Chipping at corners of cermet chip that occurred in grinding |
|---|---|---|---|---|---|
| 1 | 67.0 | 615 | 1.5 | 42 | None |
| 2 | 25.0 | 229 | 2.0 | 56 | None |
| 3 | 35.0 | 321 | 1.3 | 36 | None |
| 4 | 10.9 | 100 | 3.6 | 100 | Yes, small chipping |
| 5 | 17.3 | 159 | 2.2 | 61 | None |
| 6 | 12.0 | 110 | 2.2 | 61 | None |
| 7 | 16.4 | 150 | 2.6 | 72 | None |
| 8 | 7.2 | 66 | 3.8 | 106 | Yes, small chipping |
| 9 | 7.3 | 67 | 5.0 | 139 | Yes, large chipping |
| 10 | — | — | 6.0 | 166 | Continuous grinding impossible due to large chipping |

What is claimed is:

1. A grinding tool for grinding cermet workpieces, comprising diamond super abrasive grains as an abrasive, and a bond to retain said abrasive, said bond being made of one of an organic polymer and a metal as a base material, and containing as a filler both a solid film-forming lubricant and diamond super-abrasive grains having a grain size smaller than that of said diamond super abrasive grains as the abrasive, whereby said smaller diamond super abrasive grains improve bond wear resistance, and prevent loading of the tool by grinding and discharging the surface layer and chips from the cermet workpiece which would otherwise contact the bond.

2. A grinding tool as claimed in claim 1, wherein said diamond superabrasive grains as the filler have an average grain size smaller than one-third that of said diamond superabrasive grains as the abrasive.

3. A grinding tool as claimed in claim 1, wherein said solid film-forming lubricant is at least one of boron nitride of hexagonal system, and tungsten disulfide.

4. A grinding tool as claimed in claim 1, wherein the content of said solid film-forming lubricant in said bond is 3 to 40 vol %.

5. A grinding tool as claimed in claim 2, wherein the content of said diamond superabrasive grains as the filler in said bond is 3 to 30 vol %.

6. A grinding tool as claimed in claim 1, wherein said bond is made of organic polymer, said diamond superabrasive grains as the filler have an average grain size smaller than one-third that of said diamond superabrasive grains as the abrasive, said solid film-forming lubricant as the filler is at least one of boron nitride of hexagonal system, and tungsten disulfide, and the content of said solid film-forming lubricant in said bond is 3 to 20 vol %.

7. A grinding tool as claimed in claim 1, wherein said bond is made of a Cu-Sn alloy, said diamond superabrasive grains as the filler have an average grain size smaller than one-third that of said diamond superabrasive grains as the abrasive, said solid film-forming lubricant as the filler is at least one of boron nitride of hexagonal system, and tungsten disulfide, and the content of said solid film-forming lubricant in said bond is 5 to 40 vol %.

* * * * *